United States Patent [19]

Thinesen

[11] Patent Number: 4,989,188

[45] Date of Patent: Jan. 29, 1991

[54] PROGRAM TO DISPLAY AN ALTERNATE MODE IN A MULTIMODE TIMEPIECE

[75] Inventor: Tom Thinesen, San Jose, Calif.

[73] Assignee: Timex Corporation, Middlebury, Conn.

[21] Appl. No.: 465,868

[22] Filed: Jan. 16, 1990

[51] Int. Cl.[5] ..... G04C 17/00; G04B 19/04

[52] U.S. Cl. ..... 368/70; 368/80; 368/187

[58] Field of Search ..... 368/69, 70, 21, 22, 368/72–73, 82–84, 185–187, 319–321

[56] References Cited

U.S. PATENT DOCUMENTS 4,058,971 11/1977 Edderson ..... 368/70

4,182,108 1/1980 Chihara ..... 368/70

4,320,478 3/1982 Daniels et al. ..... 368/69

4,681,460 7/1987 Nishimura ..... 368/21

*Primary Examiner*—Vit W. Miska

*Attorney, Agent, or Firm*—William C. Crutcher

[57] ABSTRACT

A multimode electronic timepiece has a display, a group plurality of manually actuated switches, and an integrated circuit programmed to keep time and to provide several operating modes including time-of-day mode. The integrated circuit is programmed to permit an operator to sequentially shift the current mode of operation from one mode to the next by selectively and repetitively actuating a first switch. The improved timepiece includes an alternate mode selection when a second switch is temporarily depressed to display the operating condition of a mode other than the current mode. The display returns to the current mode when the second switch is no longer actuated.

9 Claims, 4 Drawing Sheets

PROGRAM TO DISPLAY AN ALTERNATE MODE IN A MULTIMODE TIMEPIECE

BACKGROUND OF THE INVENTION

This invention relates generally to multimode electronic timepieces. More particularly, the invention relates to an improved program for determining the condition of a mode other than the one in which the wristwatch is currently engaged.

Multimode, multifunction wristwatches (or wrist instruments) are known which include a display, a lamp for illuminating the display, a number of manually actuated switches and an integrated circuit programmed in a preselected sequence. Examples of such watches are seen in Houlihan et al, U.S. Pat. No. 4,783,773, Houlihan U.S Pat. No. 4,780,864 and Horan U.S. Pat. No. 4,283,784, all of the foregoing being assigned to the present assignee. In the foregoing patents, which are merely exemplary of multimode electronic wrist instruments or multifunction wristwatches, one of the manual actuators may typically serve to repetitively cycle the instrument through a number of modes or operating states in each of which a different type of information is displayed. Such modes may include, in a multifunction watch, the time of day, chronograph, dual time zone, elapsed time and an alarm setting mode. By special preselected actuation of one of the switches, the wristwatch may be further converted into a computer, a speedometer, pulsometer or any other type of device, subject only to the imagination of the designer and programmer of the integrated circuit. While in any of these modes, another manual switch actuator may be employed to change the information being displayed in that mode or state, such as initiating the chronograph timing or setting the time of-day or setting the alarm time or performing a calculation.

Watches are known wherein information stored in a memory location may be recalled for temporarily displaying the information by actuation of a switch. For example, a data bank watch Model DB-60, manufactured by Casio Computer Co. Ltd., has a keyboard switch which may be used to review the last telephone number or the next scheduled alarm time while operating in the time-of-day mode. The telephone number and/or scheduled alarm time comprise information residing in one or more memory locations and are entered into those locations by the user.

A problem existing with multimode electronic timepieces is the desire to know the status of an operating mode other than one in which the timepiece is currently operating. One common situation where this would be useful is where the multimode watch includes an alternate time zone. Since a multimode watch normally includes a manually actuated switch for shifting from one mode to the next in a predetermined sequence, it is necessary to cycle through all of the modes from time-of-day, to the alternate time zone and then to continue the sequence back to time-of-day. A similar situation takes place when it is desired to know the alarm set time without cycling through the entire predetermined schedule of change of modes.

Accordingly, one object of the present invention is to provide an improved program for reviewing the status of a mode in a multimode watch other than the mode in which the watch is currently operating.

Another object of the present invention is to provide an improved method for determining the status of an alternate mode in a multimode electronic wristwatch.

SUMMARY OF THE INVENTION

Briefly stated, the invention comprises an improvement in an multimode electronic timepiece having a display, a plurality of manually actuated switches, and an integrated circuit programmed to keep time and to provide a plurality of modes including time-of-day mode, said integrated circuit being programmed to permit an operator to sequentially shift the current mode of the operation from one mode to the next by selectively and repetitively actuating a first of said switches, wherein said improvement comprises:

mode selection means responsive to selective actuation of a second of said switches adapted to display the operating condition of a mode other than the current mode and further adapted to automatically return the display to the current mode when said second selected switch is no longer actuated.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
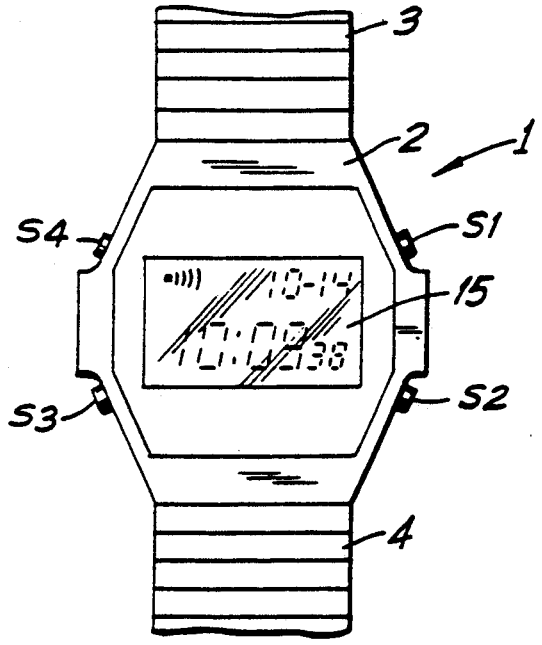
PRIOR ART FIG. 1
FIG. 1 is a plan view of a multimode electronic wristwatch in simplified form.

Referring now to FIG. 1 of the drawing, a multimode electronic wristwatch 1 includes a case 2 adapted to be held on the wrist by a strap, portions of which are seen at 3 and 4. The wristwatch case includes 4 manual push-button actuators S1, S2, S3, S4 arranged to close spring contacts (not shown) inside the watch case 2. An electroptic display 15, which is commonly a liquid crystal display (or LCD) displays digits, letters or other symbols when activated by a microcomputer inside the watch in the form of an integrated circuit.

Figure 2:
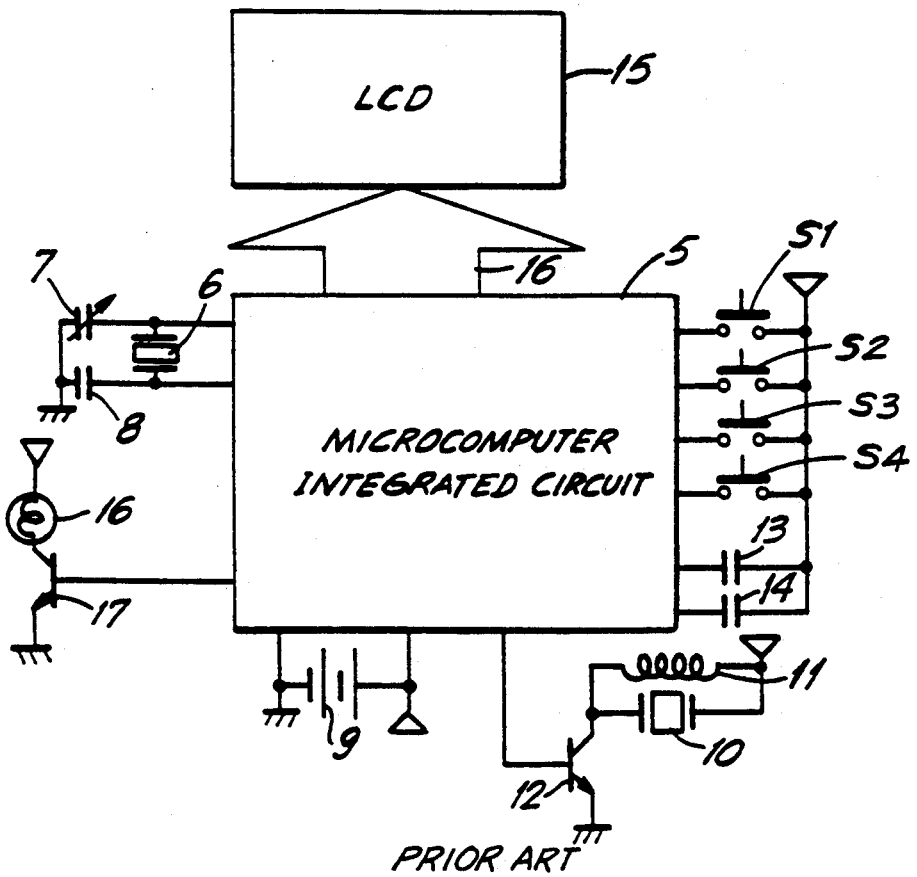
PRIOR ART FIG. 2
FIG. 2 is a block diagram of a circuit for the wristwatch of FIG. 1, together with external components such as lamp, switches and display.

Referring to FIG. 2 of the drawing, a schematic block diagram of the electrical connections is shown which is in accordance with conventional multimode electronic watch technology well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. The microcomputer includes a microprocessor, operating system program for carrying out instructions, and memory locations. A quartz crystal 6 connected in circuit with capacitor 7 and 8 and connected to the oscillator pins of the integrated circuit 5 provide a high-frequency time base.

A battery power source 9 is provided in the form of a button type energy cell in the watch case. A watch alarm is made up of a piezoelectric crystal 10, inductance coil 11 and drive transistor 12. Two fixed external capacitors 13, 14 combined with other circuit elements combined inside the integrated circuit 5 serve to boost the output voltage to drive LCD 15 through a display bus 16, which represents the several parallel leads connected to the various actuatable segments of the LCD dispay 15 (also shown in FIG. 1). Display 15 is arranged in close proximity with, so as to be illuminated by, a lamp 17 when the lamp is lit by a switching signal from integrated circuit 5 applied to the base of switching transistor 18.

Figure 3:
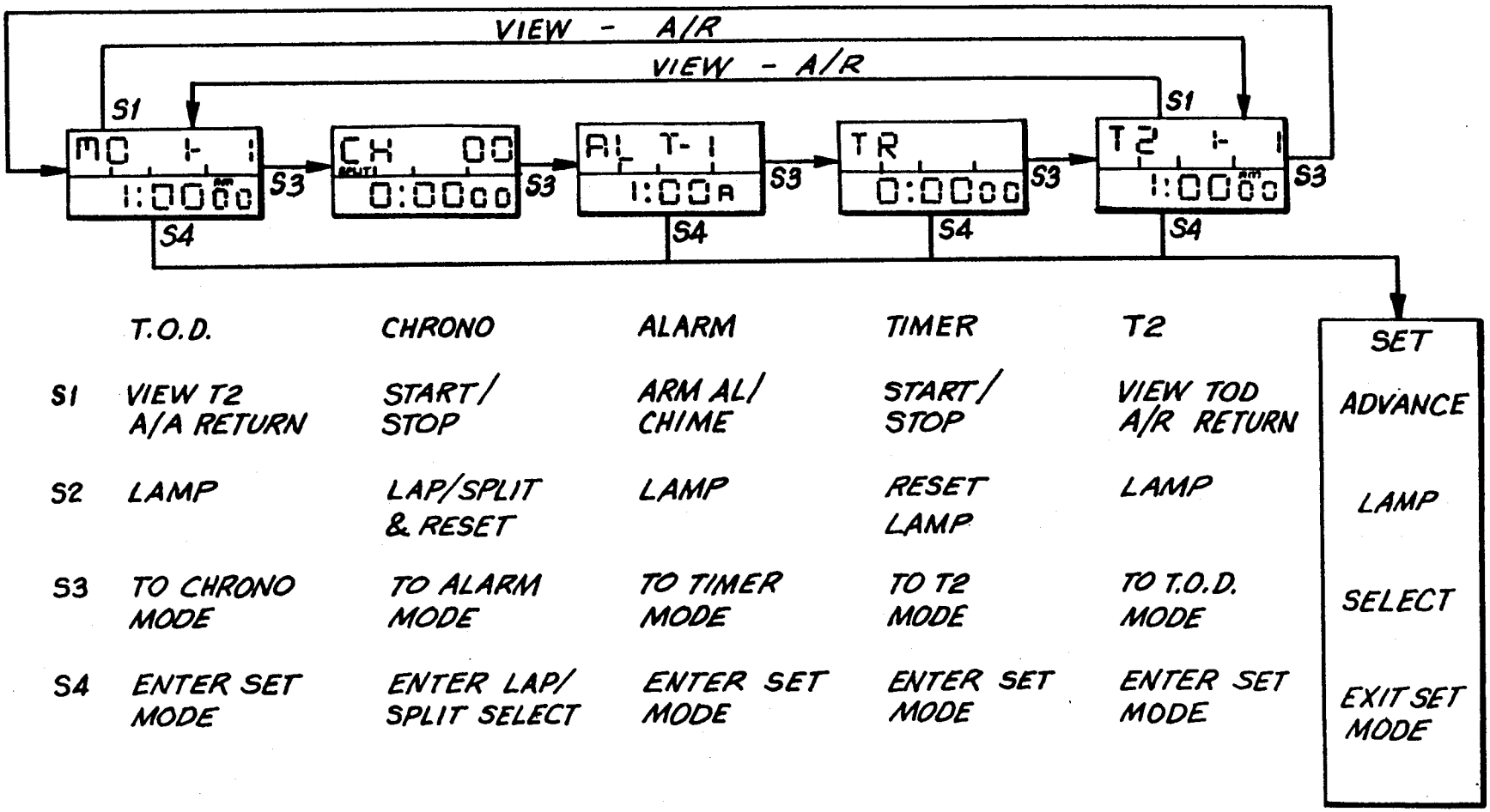
FIG. 3 is a block diagram of a multimode wristwatch illustrating sequence of states in response to manually actuated switches.

Referring now to FIG. 3 of the drawing, a block diagram of a multimode wristwatch illustrates the sequence of modes or states in response to manually actuating switches S1–S4 in accordance with the table. Each of the blocks illustrates the appearance of the display at start-up for the modes illustrated. Beneath each of the display blocks is a column illustrating what happens when the respective switches S1–S4 are actuated while in that mode. The modes for this particular timepiece are time-of-day (TOD), chronograph (CHRONO), alarm setting (ALARM), elapsed time (TIMER), alternate time zone (T2). As indicated in the row opposite switch S3, the program is arranged to shift modes sequentially in a continuous ring. Once in one of the five modes illustrated, actuation of switch S4 sets up a subroutine SET for changing the information displayed. Switch S3 will SELECT a particular piece of information which is indicated on the display by "flashing" the indicia for that piece of information, and switch S1 will ADVANCE the selected bit of information. In accordance with the present invention, an alternate means of viewing another mode is by operating switch S1, and then releasing it to automatically return to the current operating mode. This alternate means is illustrated by arrows between TOD mode and T2 mode in FIG. 3.

Figure 4:
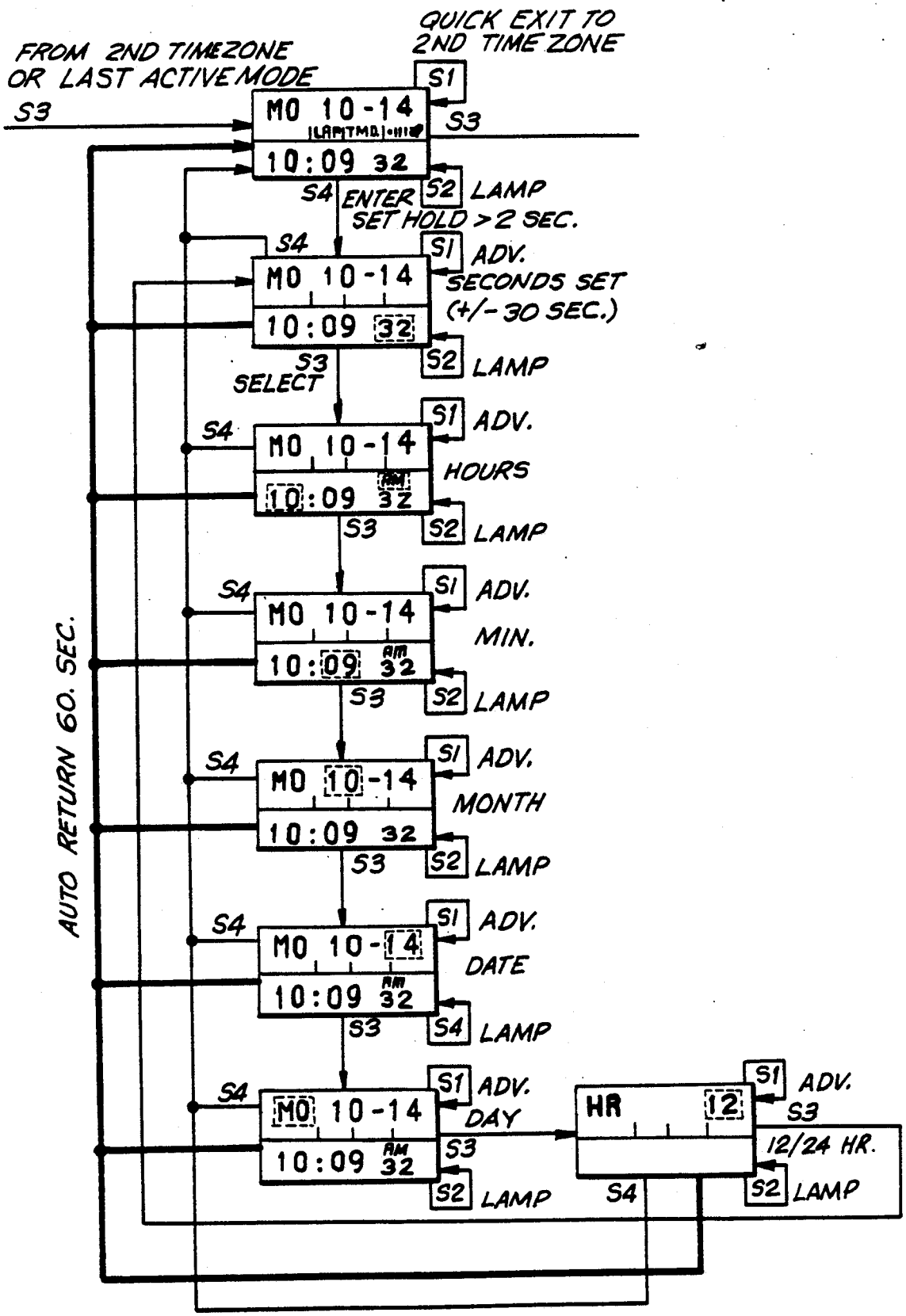
FIG. 4 is a detailed state diagram of time-of-day mode.
Figure 5:
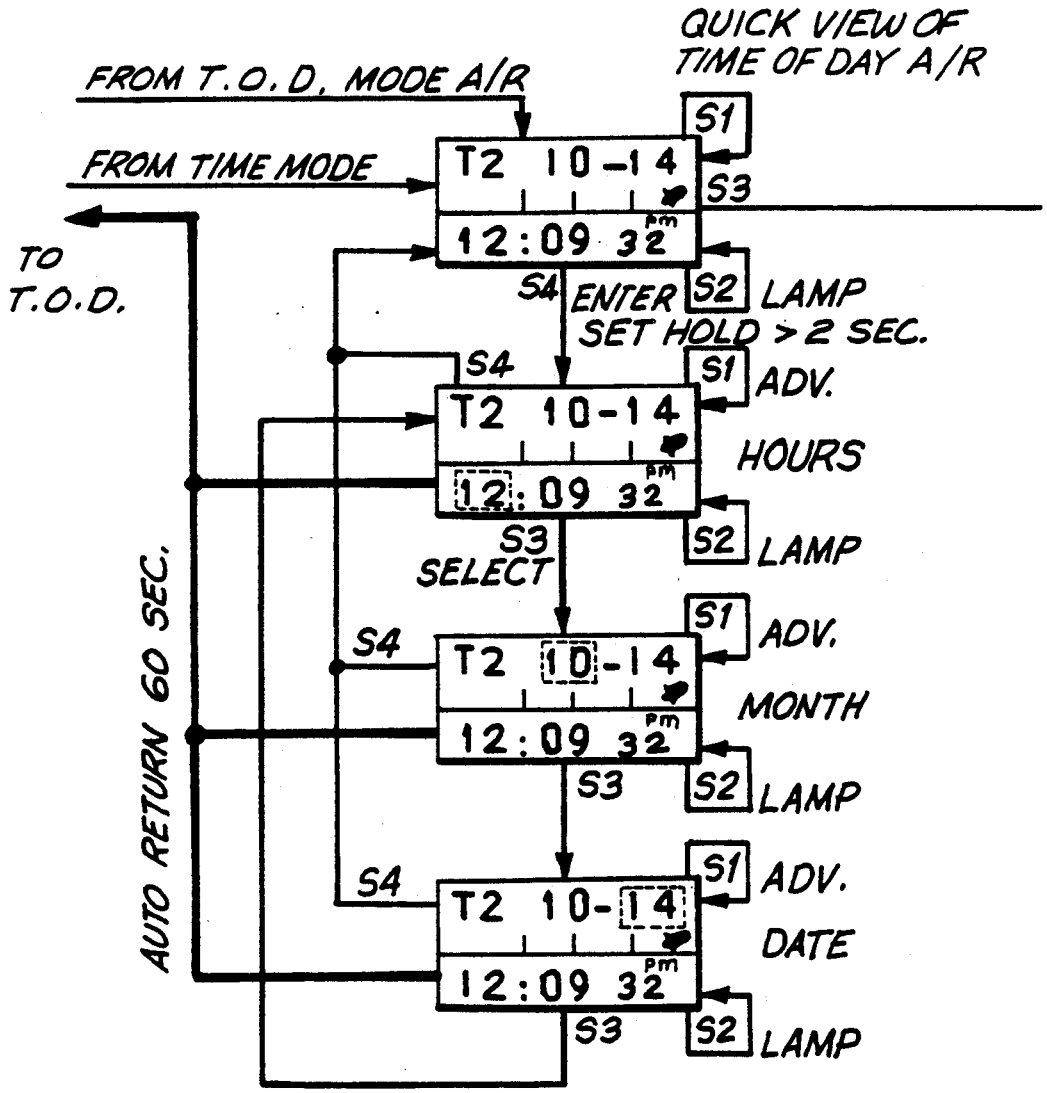
FIG. 5 is a detailed state diagram of alternate time zone mode.

Referring now to FIG. 4 and 5 of the drawing, "state" diagrams are shown in schematic form, for time-of day setting, alternate time zone setting and alarm setting, respectively. Each of the top rectangles describes the type of display shown on the electroptical display 15 when the instrument is in that state. The lower rectangles represent a state in which change of displayed information may be controlled by the operator. The dotted rectangle indicates which part of the displayed information will be changed when the S1 switch is actuated. The instrument continues to keep time and to operate under control of the particular subroutine of the program in the microcomputer chip until the instrument is placed into another state. Manipulation of the electronic wristwatch to illuminate the display and carry out the various functions and capabilities is by selective actuation of the manually actuated switches S1–S4. The well known programming technique for determining whether the switches are opened or closed and taking appropriate action is through the operating system computer program stored in the microcomputer memory, in which each switch condition is tested during each complete interrogation cycle in a loop. If any switch is closed, the program branches to a subroutine which initiates a counter. The counter determines how long the switch has been closed or, if the watch has entered another "state" how long it has been in that "state".

Reference to FIG. 4 illustrates the detailed state diagram of the time-of-day mode. This is the basic timekeeping function of the timepiece and illustrates the general method of setting time-of-day. The integrated circuit is programmed to set time-of-day in response to actuation of selected switches in a known manner. Once the set mode is entered from the top block by pressing switch S4 for more than two seconds, a sequence is initiated by which a bit of information to be corrected may be selected by pressing switch S3 successively. For example, in the fourth block down, the "minutes" are selected for correction which is indicated in the drawing by a dotted rectangle around the "09". In an actual watch display, the "09" would flash off and on while the remaining digits remained on. Subsequent actuation of switch S1 will advance the minutes to a new setting.

Reference to FIG. 5 illustrates the alternate time zone mode setting sequence The integrated circuit is programmed to set alternate time zone time in response to actuation to selected switches. Once the setting sequence is entered by pressing switch S4 and holding it for more than two seconds, the hours, month and date may be selected and corrected by the user. It is unnecessary to select minutes and seconds, because these correspond to the local TOD minutes and seconds.

In accordance with the present invention, the operating program of the microcomputer is arranged to provide an alternate type of mode selection, other than the sequential cycling through modes by means of switch S3. This alternate type of mode selection is only for the purpose of temporarily viewing the operating status of a mode by displaying it for as long as the manual actuator, in this case the S1 pushbutton, is actuated. When the pushbutton is released so that the switch closure is no longer made, the operating program which periodically determines the condition of the switch closure will cause the display to indicate the condition of the current mode rather than the alternate mode.

Referring to FIG. 3, the basic repetitive sequence of mode selection is indicated as taking place upon repetitive actuation of switch S3. However, it is noted that the program further provides for actuation of switch S1 from the TOD mode to view the alternate time zone T2 display with automatic return, A/R indicating return when the actuator S1 is released.

Reference to the detail flow chart of FIG. 4 indicates the same provision in more detail. In the upper box, it is shown that actuation of switch S1 causes a "quick exit to second time zone" for as long as switch S1 is actuated. However, once the watch has entered the time-of-day setting subroutine SET by pressing switch S4, switch S1 now performs a different function to advance or correct the selected bit of information to be corrected.

The programming steps necessary to accomplish viewing the status of an alternate mode without permanently entering that mode are well within the scope of those skilled in the art. The operating condition of switch S1 is checked for a switch closure. If closed, when the timepiece is in the state represented by the top rectangle of FIG. 4, then the program branches to a subroutine which displays the contents of the registers or memory locations of a preselected alternate mode of operation.

The foregoing program to display an alternate mode in multimode timepiece may be extended to view any mode other than the current mode, so long as there is a switch actuator available which is not performing some other assigned function. For example, in the present timepiece, provision is further made to review the status of the TOD mode from the alternate time zone mode T2. In FIG. 3 this is indicated as an oppositely directed flow arrow from T2 to TOD upon pressing actuator S1, with an automatic return when actuator S1 is released.

Review of the detailed flow chart of the second time zone mode in FIG. 5 shows this in more detail. Actuator S1 may be pressed when the watch is keeping time in the alternate time zone (top block of FIG. 5). If the second time zone mode is caused to enter the SET subroutine by pressing actuator S4, then switch S1 no longer performs the above function but serves to advance or correct the information which has been selected for correction.

Other examples of use of the invention would be to view the alarm time setting from time-of-day mode, to view the alarm time setting from alternate time zone mode, to view the status of chronograph or elapsed time from either time of day or alternate time zone modes, etc.

The term "state" and the "mode" are used interchangeably herein and are not intended by way of limitation.

While there has been described what is considered to be the preferred embodiment of the invention, other modifications will become known to those skilled in the art and it is desired to cover, in the appended claims, all such modifications as fall within the true spirit and scope of the invention.

I claim:

1. Improvement in a multimode electronic timepiece having a display, a plurality of manually actuated switches, and an integrated circuit programmed to keep time and to provide at least three modes including time-of-day mode, said integrated circuit being programmed to permit an operator to sequentially cycle to timepiece from a current mode of operation to the next mode of operation by selectively and repetitively actuating a first of said switches, wherein said improvement comprises:

mode selection means including a program for said integrated circuit responsive to selective actuation by said operator of a second of said switches and adapted to temporarily display the status of an operating mode other than the current mode; whereby said operator can avoid cycling said timepiece through intervening modes (1) in order to temporarily display an other than current mode, and/or (2) in order to return said timepiece from other than current mode to current mode; said program being further adapted to automatically again display the current mode when said second selected switch is no longer actuated.

2. The improvement according to claim 1, wherein said current mode is time-of-day and wherein said mode other than the current mode is an alternate time zone mode.

3. The improvement according to claim 1, wherein said current mode is an alternate time zone and wherein said mode other than the current mode is time-of-day.

4. The improvement according to claim 1, wherein said mode selection means provides for reciprocal temporary display between two modes, either of which may be said current mode at a selected time.

5. The improvement according to claim 1, wherein said current mode is time-of day and wherein said mode other than the current mode is an alarm setting mode.

6. The improvement according to claim 1, wherein said current mode is time-of-day and said mode other than current mode is a chronograph mode.

7. The improvement according to claim 1, wherein said current mode is an alarm setting mode and wherein said mode other than current mode is time-of-day.

8. The improvement according to claim 1, wherein said current mode is chronograph mode and said mode other than current mode is time-of-day.

9. The improvement according to claim 1, wherein said integrated circuit is programmed to provide more than three modes and having a third manually actuated switch, said third switch being adapted to temporarily display the status of an additional operating mode other than the current mode or that mode displayed by the actuation of said second manually actuated switch.

* * * * *